US008713853B2

(12) United States Patent
Toro

(10) Patent No.: US 8,713,853 B2
(45) Date of Patent: May 6, 2014

(54) ADJUSTABLE GATE

(75) Inventor: Joseph Toro, Port Jefferson Station, NY (US)

(73) Assignee: AZEK Building Products, Inc., Scranton, PA (US)

( * ) Notice: Subject to any disclaimer, the term of this patent is extended or adjusted under 35 U.S.C. 154(b) by 0 days.

(21) Appl. No.: 13/347,013

(22) Filed: Jan. 10, 2012

(65) Prior Publication Data

US 2012/0174484 A1 Jul. 12, 2012

Related U.S. Application Data

(60) Provisional application No. 61/431,579, filed on Jan. 11, 2011.

(51) Int. Cl.

| | |
|---|---|
| ***E05D 15/00*** | (2006.01) |
| ***E06B 3/34*** | (2006.01) |
| ***E06B 11/00*** | (2006.01) |

(52) U.S. Cl.
USPC ..... 49/381

(58) Field of Classification Search
USPC ..... 49/50, 55, 56, 57, 463, 381; 248/201
See application file for complete search history.

(56) References Cited

U.S. PATENT DOCUMENTS

| | | | | | |
|---|---|---|---|---|---|
| 3,037,593 | A * | 6/1962 | Webster | 52/476 |
| 3,304,656 | A * | 2/1967 | Dvorak | 49/247 |
| 3,770,245 | A * | 11/1973 | Murdock | 256/24 |
| 3,879,893 | A * | 4/1975 | Helmick | 49/420 |
| 3,906,759 | A * | 9/1975 | Schwing et al. | 70/128 |
| 4,809,955 | A * | 3/1989 | Veilleux | 256/65.02 |
| 5,592,717 | A | 1/1997 | Longo | |
| 5,702,090 | A * | 12/1997 | Edgman | 256/19 |
| 6,152,428 | A * | 11/2000 | Simioni | 256/24 |
| 6,637,728 | B2 * | 10/2003 | Pettit et al. | 256/19 |
| 6,715,182 | B2 | 4/2004 | Cheng | |
| 7,000,289 | B2 * | 2/2006 | Cedrone | 16/309 |
| 7,503,550 | B2 * | 3/2009 | Liefke | 256/24 |
| 7,744,065 | B2 | 6/2010 | Terrels et al. | |
| 7,934,699 | B2 * | 5/2011 | Zell et al. | 256/24 |
| 8,132,791 | B2 * | 3/2012 | Stucker | 256/19 |
| 8,235,341 | B2 * | 8/2012 | Taylor | 248/292.14 |
| 8,341,886 | B2 * | 1/2013 | Yates | 49/55 |
| 2002/0116788 | A1 | 8/2002 | Pompei | |
| 2004/0051092 | A1 * | 3/2004 | Curatolo | 256/19 |
| 2008/0179581 | A1 | 7/2008 | Mulgrew | |
| 2008/0244983 | A1 | 10/2008 | Peterson | |
| 2011/0308160 | A1 * | 12/2011 | Boucquey | 49/50 |
| 2012/0324792 | A1 * | 12/2012 | Bertsch et al. | 49/37 |

* cited by examiner

*Primary Examiner* — Katherine Mitchell
*Assistant Examiner* — Shiref Mekhaeil
(74) *Attorney, Agent, or Firm* — Buchanan Ingersoll & Rooney PC

(57) ABSTRACT

An adjustable gate has a gate panel, a pivoting plate attached to the gate panel, a mounting plate, and a pivot pin. The pivoting plate and the mounting plate each have a base and two parallel sides attached to the base and each of the parallel sides have a triangular shape and one side is substantially similar in shape to the other side. Each triangular shaped side has an apex and a pivot pin hole near the apex. The pivot pin passes through the pivot pin holes in the side of the pivoting plate and the sides of the mounting plate and connects the pivoting plate to the mounting plate.

17 Claims, 6 Drawing Sheets

ADJUSTABLE GATE

CROSS REFERENCE TO RELATED APPLICATION

This application claims the benefit of provisional application Ser. No. 61/431,579, filed Jan. 11, 2011.

BACKGROUND OF THE INVENTION

1. Field of the Invention

The present invention relates to improvements in gate systems. More particularly the invention relates to easy to an assemble gate with an adjustment mechanism.

2. Description of the Related Art

Fences are widely used to keep animals and people within or away from spaces surrounded by a fence. One or more gates may be used with a fence. Many homes as well as restaurants and some commercial buildings have outdoor decks and porches. Owners of decks may desire to have a gate to increase the security and aesthetic appeal of a deck or porch. Recently, gate assemblies have been manufactured from plastics such as high-density polyurethane and other alternatives to natural wood.

In general, such assemblies have gathered attention because they provide less maintenance and simpler installation at a lower cost than traditional wood construction. Plastic railing and trim assemblies are nearly impervious to moisture and therefore will not rot or decay like natural wood. Further, during the manufacture of these assemblies, plastic can be tinted with dyes or other materials to provide a specific color to a component, thus removing the need for surface preparation and painting prior to or subsequent to installing the trim assembly.

Additionally, gates are traditionally sold as components pieces that require assembly. Kits have been sold that contain the necessary components for making a gate. However, these gate components typically require modification and attachment of hardware components to the gate. These modification and hardware attachment steps can be performed incorrectly by a novice. Furthermore, level adjustment of these gates in typically performed during installation of the gate panel and any adjustments made are permanent by the installation. The combination of incorrect modification of components, incorrect hardware attachment, and difficulties associated with level adjustment can lead to a gate that is not pleasing to look at and which does not open and close properly.

Thus there is a need for an adjustable gate system that is easy to manufacture and install, and allows for easy level adjustment of the gate.

SUMMARY OF THE INVENTION

An adjustable gate is disclosed herein that comprises a gate panel, a pivoting plate attached to the gate panel, and a mounting plate. The pivoting plate and the mounting plate each have a base and two parallel sides attached to the base, each of the parallel sides have a triangular shape and one side is substantially similar in shape to the other side. Further, each triangular shaped side has an apex and a pivot pin hole near the apex. In addition, a pivot pin passing through the pivot pin hole in the sides of the pivoting plate and the sides of the mounting plate and connecting the pivoting pin plate to the mounting plate.

In a preferred embodiment of the adjustable gate, the gate panel comprises a top railing that has first end and a second end, a bottom railing that has a first end and a second end, a first end cap having a first end and a second end, a second end cap having a first end and a second end. The first end of the first end cap has a first pocket and the second end of the first end cap has a second pocket. The first end of the second end cap has a first pocket, and the second end of the second end cap has a second pocket. The first end of the top railing engages the first pocket of the first end cap and the second end of the top railing engages the first pocket of the second end cap. The first end of the bottom railing engages the second pocket of the first end cap and the second of the bottom railing engages the second pocket of the second end cap.

In a further preferred embodiment of the adjustable gate, the gate panel further comprises a plurality of balusters each having two ends. Each baluster attaches to the top railing at one end and attaches to the bottom railing at the other end.

In still a further preferred embodiment of the adjustable gate, the top railing comprises a top railing cover section and a first reinforcing member that has a first end and a second end. The bottom railing comprises a bottom railing cover section and a second reinforcing member that has a first end and second end. The top railing cover section engages the first reinforcing member and the bottom railing cover section engages the second reinforcing member. The first end of the first reinforcing member engages the first pocket of the first end cap, the first end of the second reinforcing member engages the second pocket of the first end cap, the second end of the first reinforcing member engages the first pocket of the second end cap, and the second end of the second reinforcing member engages the second pocket of the second end cap.

In another preferred embodiment of the adjustable gate, the gate panel further comprises a first top cap, a first bottom cap, a second top cap, and a second bottom cap. The first top cap is sized and configured to cover an engagement of the first end of the first reinforcing member and the first pocket of the first end cap, the first bottom cap is sized and configured to cover an engagement of the first end of the second reinforcing member and the second pocket of the first end cap, the second top cap is sized and configured to cover an engagement of the second end of the first reinforcing member and the first pocket of the second end cap, and the second bottom cap is sized and configured to cover an engagement of the second end of the second reinforcing member and the second pocket of the second end cap.

In yet another preferred embodiment of the adjustable gate, the first end cap, the second end cap, the top railing cover section, and the bottom railing cover section are a plastic extrusion.

In still another preferred embodiment of the adjustable gate, the first reinforcing member and the second reinforcing member are an extrusion.

In a further embodiment of the adjustable gate, the pivoting plate and the mounting plate are made of metal.

In yet another preferred embodiment of the adjustable gate, the adjustable gate further comprises at least one hinge that attaches to the pivoting plate and to the gate panel.

In yet a further preferred embodiment of the adjustable gate, the at least one hinge comprises a first hinge body and a second hinge body. The first hinge body is attached to the gate panel and the second hinge is attached to the pivoting plate. The first hinge body is sized and configured to be removeably engaged with the second hinge body.

In still another preferred embodiment of the adjustable gate, the first hinge body is sized and configured to return to a first position relative to the second hinge body if the first hinge body is displaced from the first position.

In yet a further preferred embodiment of the adjustable gate, the adjustable gate further comprises a cane bolt and associated striker plate. The cane bolt attaches to the first end cap.

Also disclosed herein is an adjustable gate that comprises a first reinforcing member that has first end and a second end, a second reinforcing member that has a first end and a second end, a first end cap that has a first end and a second end, a second end cap that has a first end and a second end, a top railing cover section, a bottom railing cover section, and a pivotable mount assembly that has a first section and a second section. The first end of the first end cap has a first pocket and the second end of the first end cap has a second pocket. The first end of the second end cap has a first pocket and the second end of the second end cap has a second pocket.

In addition, the first end of the first reinforcing member engages the first pocket of the first end cap and the second end of the first reinforcing member engages the first pocket of the second end cap. Further, the first end of the second reinforcing member engages the second pocket of the first end cap and the second of the second reinforcing member engages the second pocket of the second end cap. Additionally, the top railing cover section engages the first reinforcing member and the bottom railing cover section engages the second reinforcing member.

Further, the first section of the pivotable mount assembly is sized and configured to be mounted to a surface and the second section of the pivotable mount assembly is attached to the second end cap such that the first section and the second section of the pivotable mount assembly are configured and connected together to permit pivotable adjustment of the adjustable gate in which at least one end of the second section is moved toward or away from a corresponding end of the first section.

In a preferred embodiment of the adjustable gate, the first section of the pivotable mount assembly comprises a mounting plate and the second section of the pivotable mount assembly comprises a pivoting plate. The pivotable mount assembly further comprises a pivot pin. The pivoting plate is sized and configured to be mounted to the second end cap and the pivot pin holds the mounting plate and the pivoting plate in a pivoting engagement. The pivotable adjustment is accomplished based on rotational motion of the pivoting plate about the pivot pin relative to the mounting plate.

In another preferred embodiment of the adjustable gate, the pivotable mount assembly further comprises a setscrew. The setscrew is sized and configured such that setscrew restricts movement of the pivoting plate about the pivot pin.

In a further preferred embodiment of the adjustable gate, the mounting plate has an apex with an aperture defined at the apex and the pivoting plate has an apex with an aperture defined at the apex. The pivot pin is located within the aperture of the mounting plate and the aperture of the pivoting plate.

In another preferred embodiment of the adjustable gate, the pivotable mount assembly further comprises at least one hinge that comprises a first hinge body and a second hinge body. The first hinge body is attached to the second end cap and the second hinge is attached to the second section of the pivotable mount assembly. The first hinge body is sized and configured to be removeably engaged with the second hinge body.

Further disclosed herein is a kit for an adjustable gate that comprises a gate panel and pivotable mount assembly. The gate panel comprises a first reinforcing member that has a first end and a second end, a second reinforcing member that has first end and a second end, a first end cap that has a first end and a second end, a second end cap that has a first end and a second end, a top railing cover section, and a bottom railing cover section. The first end of the first end cap has a first pocket and the second end of the first end cap has second pocket. The first end of the second end cap has a first pocket and the second end of the second end cap has second pocket.

In addition, the first end of the first reinforcing member is sized and configured to engage the first pocket of the first end cap and the second end of the first reinforcing member is sized and configured to engage the first pocket of the second end cap. The first end of the second reinforcing member is sized and configured to engage the second pocket of the first end cap and the second of the second reinforcing member is sized and configured to engage the second pocket of the second end cap.

Additionally, the top railing cover section is sized and configured to engage the first reinforcing member and the bottom railing cover section is sized and configured to engage the second reinforcing member.

Further, the pivotable mount assembly comprises a pivoting plate sized and configured to attach to the gate panel, a mounting plate, and a pivot pin. The pivoting plate and the mounting plate each have a base and two parallel sides attached to the base and each of the parallel sides have a triangular shape with one side being substantially similar in shape to the other side. Each triangular shaped side has an apex and a pivot pin hole near the apex.

In another preferred embodiment of the kit, the kit further comprises a first top cap, a second top cap, a first bottom cap, and a second bottom cap. The first top cap is sized and configured to engage the first end of the first end cap and to cover the first pocket of the first end cap, the second top cap is sized and configured to engage the first end of the second end cap and to cover the first pocket of the second end cap, the first bottom cap is sized and configured to engage the second end of the first end cap and to cover the second pocket of the first end cap, and the second bottom cap is sized and configured to engage the second end of the second end cap and to cover the second pocket of the second end cap.

In a further preferred embodiment of the kit, the kit further comprises at least one hinge that is sized and configured to be attached to the pivoting plate and the gate panel.

Other details, objects, and advantages of the invention will become apparent as the following description of certain present preferred embodiments thereof proceeds.

BRIEF DESCRIPTION OF THE FIGURES

In the accompanying drawing I have shown certain present preferred embodiments of my decorative lighting system in which.

DESCRIPTION OF THE PREFERRED EMBODIMENTS

Figure 1:
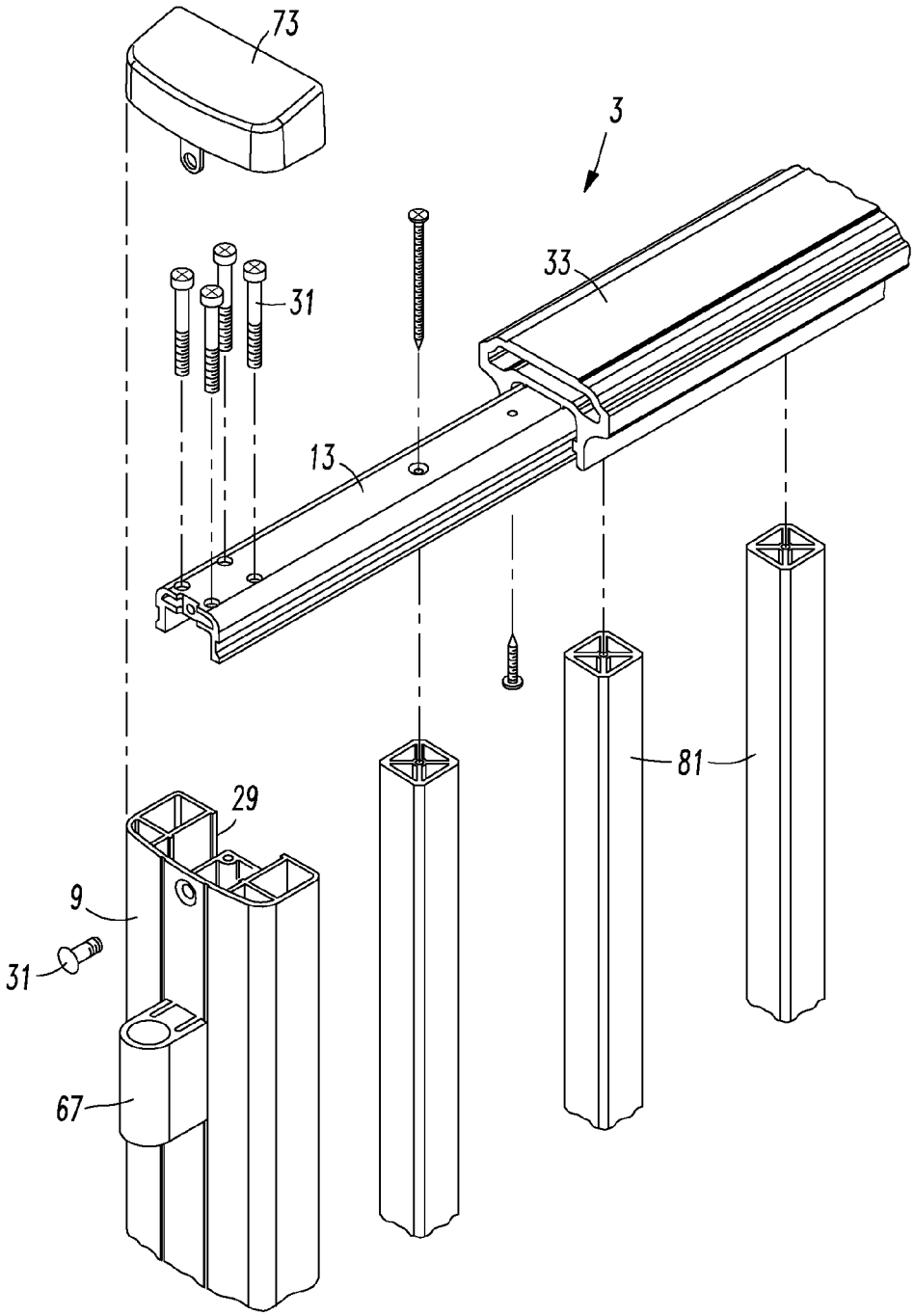
FIG. 1 is an exploded, close-up view of a present preferred embodiment of a gate panel of my adjustable gate.

Referring to the preferred embodiment shown in FIGS. 1-5, my adjustable gate 1 comprises a gate panel 3 that includes a first reinforcing member 5, a second reinforcing member 7, a first end cap 9, and a second end cap 11 that each has a first end and a second end. Further, the first end 21 of the first end cap 9 has a first pocket 29 and the second end 23 of the first end cap 9 has a second pocket (not shown). In addition, the first end 25 of the second end cap 11 has a first pocket (not shown) and the second end 27 of the second end cap 11 has a second pocket (not shown).

As shown in FIG. 1, the first end 13 of the first reinforcing member 5 engages the first pocket 29 of the first end cap 9. Similarly, the second end of the first reinforcing member 5 engages the first pocket at the first end 25 of the second end cap 11, the first end 17 of the second reinforcing member 7 engages the second pocket of the first end cap 9, and the second end (not shown) of the second reinforcing member 7 engages the second pocket at the second end 27 of the second end cap 11.

As shown in the preferred embodiment of FIG. 1, the first end 13 of the first reinforcing member 5 may be sized and configured to be held in the first pocket 29 of the first end cap by at least one fastener 31. Similarly, all the other ends of the reinforcing members of the gate panel 3 may be fastened in the pockets of the end caps 7, 11 by at least one fastener.

The adjustable gate further comprises a top railing cover section 33 and a bottom railing cover section 35. The top railing cover section 33 engages the first reinforcing member 5 to form a top railing and the bottom railing cover section 35 engages the second reinforcing member 7 to form a bottom railing. The top railing cover section 33 and the bottom railing cover section 35 may be attached to the first reinforcing member 5 and the second reinforcing member 7 using at least one fastener. In another embodiment, a respective railing cover may be slid over a respective reinforcing member and held in place based on an interference fit.

The first end cap 9, the second end cap 11, the top railing cover section 33, and the bottom railing cover section 35 may comprise any suitable material and for example, may be formed as a plastic extrusion or molded plastic piece. Further, the first reinforcing member 5 and the second reinforcing member 7 may be formed from any suitable material, such as for example a metal extrusion such as aluminum. The reinforcing members 5, 7 may also be formed from a material such as fiberglass. The first reinforcing member 5, the second reinforcing member 7, the first end cap 9, the second end cap 11, the top railing cover section 33, and the bottom railing cover section 35 may all be provided in a predetermined length and width to provide a gate panel of a particular size. Furthermore, one of ordinary skill in the art would understand that the first end cap 9, the second end cap 11, the top railing cover section 33, and the bottom railing cover section 35 may have an ornamental design or shape such that a gate panel made from these components will have a particularly desirable design.

Figure 3:
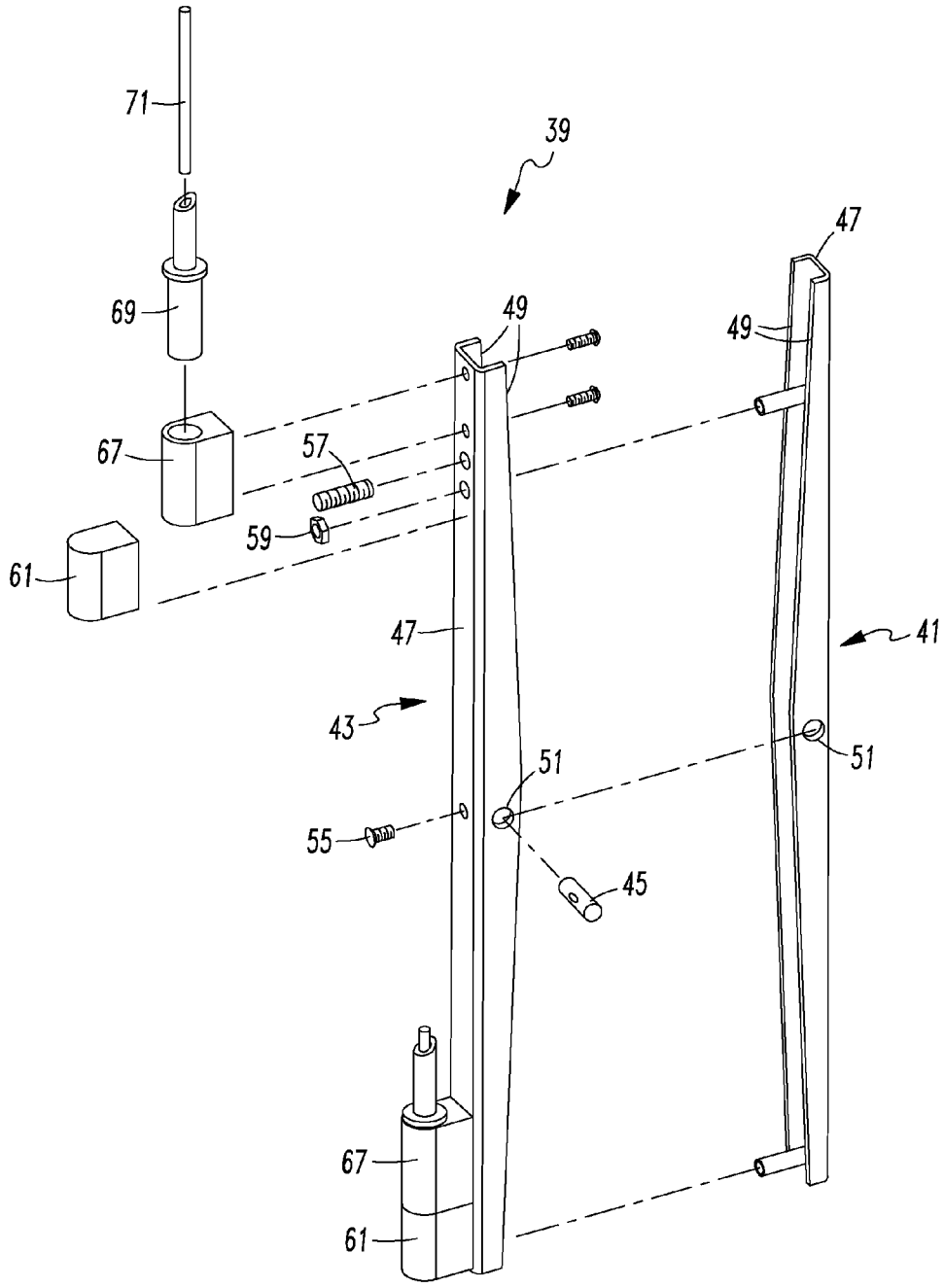
FIG. 3 is an exploded view of a present preferred embodiment of a pivotable mounting assembly of my adjustable gate.

Additionally, the adjustable gate 1 comprises a pivotable mount assembly 39 shown in FIG. 3 which has a first section 41 and a second section 43. The first section 41, or the mounting plate, of the pivotable mount assembly is sized and configured to be mounted to a surface and the second section 43, or the pivoting plate, of the pivotable mount assembly is attached to the second end cap 11. The mounting plate 41 and the pivoting plate 43 are configured and connected together to permit pivotable adjustment of the gate panel 3 in which at least one end of the pivoting plate 43 is moved toward or away from a corresponding end of the mounting plate 41. The pivoting plate and the mounting plate may be made of any suitable material, for example metal, plastic, or fiberglass.

The pivotable mount assembly 39 may also include a pivot pin 45. In the preferred embodiment shown in FIG. 3, the pivot pin 45 holds the mounting plate 41 and the pivoting plate 43 in a pivoting engagement such that pivotable adjustment is accomplished based on rotational motion of the pivoting plate 43 about the pivot pin 45 relative to the mounting plate 41. The pivoting plate 43 and the mounting plate 41 may each have a base 47 and two parallel sides 49 attached to the base 47. Each of the parallel sides has a triangular shape and one side is substantially similar in shape to the other side. Each triangular shaped side has an apex 53 and an aperture 51 that serves as a pivot pin hole near the apex. The pivot pin 45 may be located within the pivot pin hole 51 of the mounting plate 41 and the pivot pin hole 51 of the pivoting plate 43. A fastener 55, such as a screw or cotter pin, may be used to hold the pivot pin 45 in the pivot pin holes 51.

The pivotable mount assembly 39 may further comprise a setscrew 57. The setscrew 57 passes through the pivoting plate 41 and attaches to the mounting plate 43 and a threaded fastener 59, such as a nut, is placed on an end of the setscrew 57 that extends through the pivoting plate 43 and extends away from the pivoting plate 43 and the mounting plate 41. The setscrew 57 is sized and configured such that setscrew 57 restricts movement of the pivoting plate about the pivot pin 45 as the nut 59 is secured down on the setscrew 57. As can be seen in FIG. 3, the setscrew 57 will prevent the top of the pivoting plate 43 from moving away from the top of the mounting plate 41. More than one setscrew may be provided to further secure the pivoting plate from moving relative to the mounting plate. A screw cap 61 may also be included to cover the connection of the threaded fastener 59 and setscrew 57 and to provide an aesthetically pleasing appearance.

Figure 2:
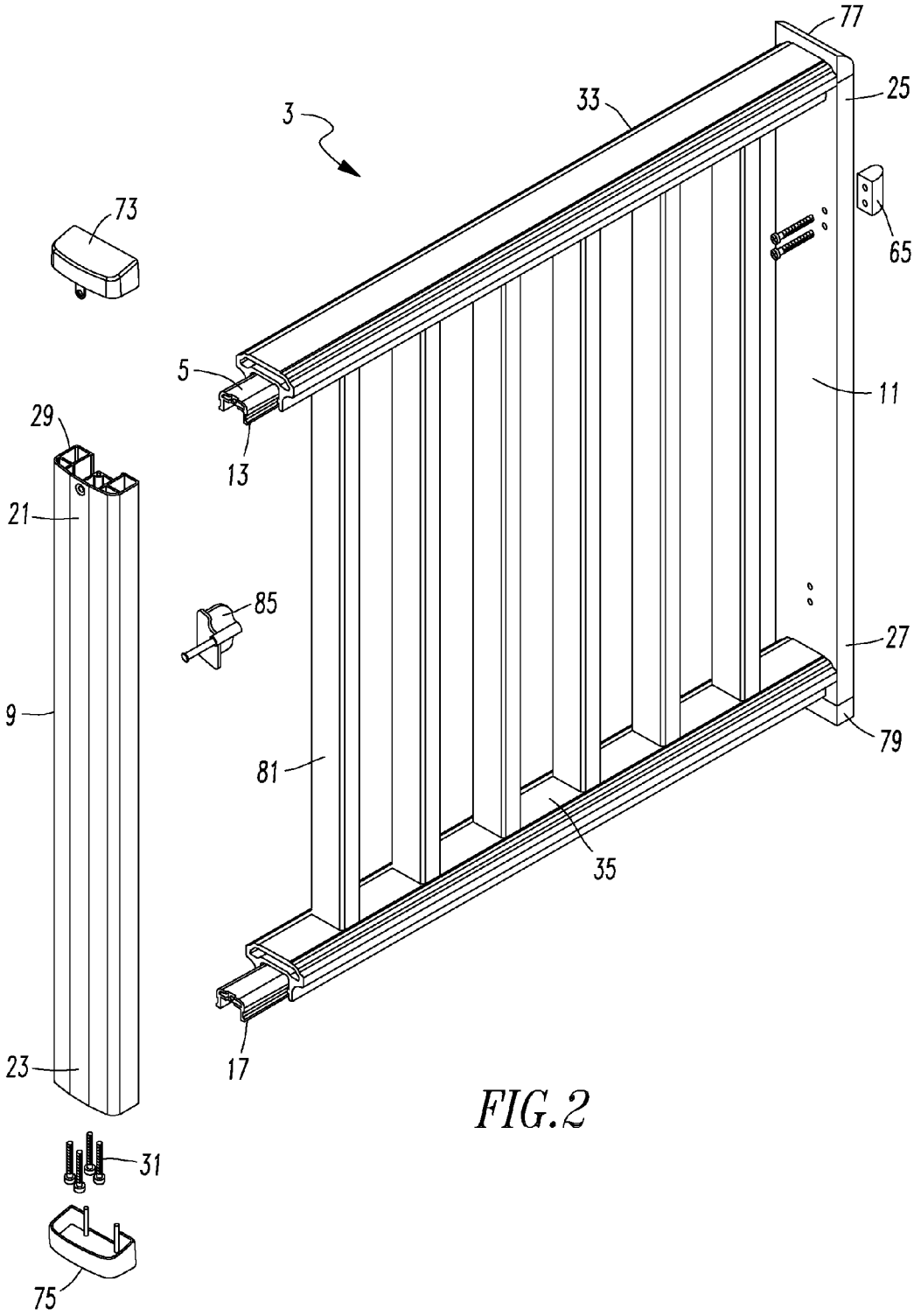
FIG. 2 is a perspective view of the partially assembled gate panel shown in FIG. 1.
Figure 4A:
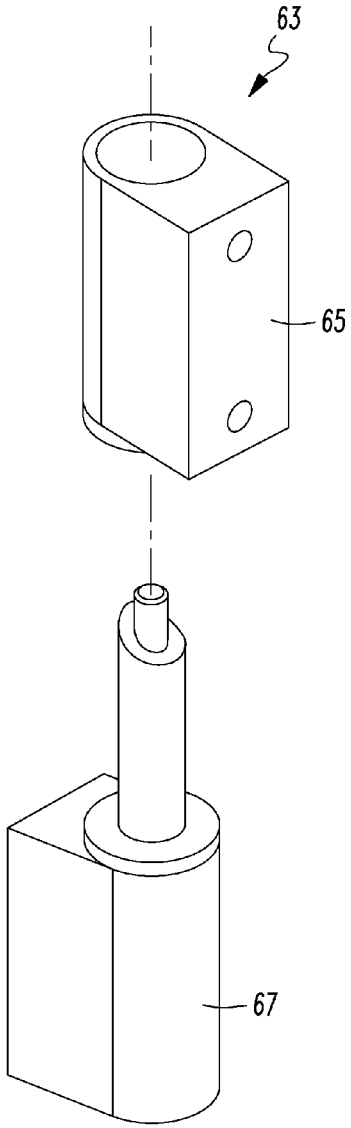
FIG. 4*a* is an exploded view of a present preferred embodiment of a hinge of my adjustable gate.
Figure 4B:
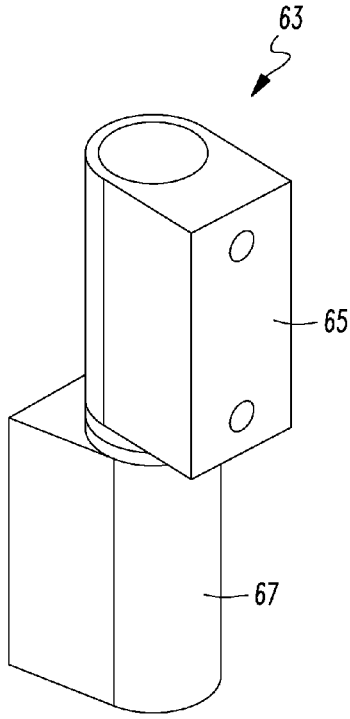
FIG. 4*b* is an assembled view of the embodiment of the hinge shown in FIG. 4*a*.
Figure 5:
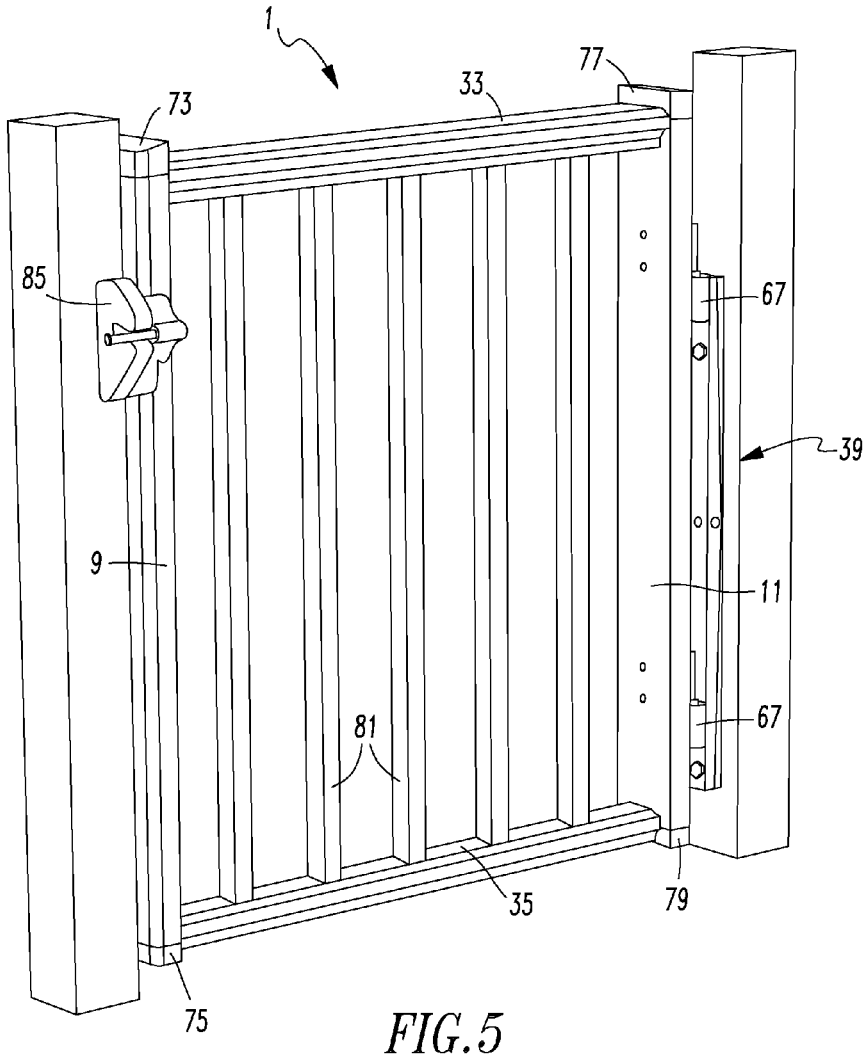
FIG. 5 is a front perspective view of a present preferred embodiment of my adjustable gate.

Furthermore, as shown in FIGS. 2 and 3, the pivotable mount assembly 39 may also include at least one hinge 63 that comprises two hinge bodies 65, 67, a hinge core 69, and a hinge pin 71. As shown in FIGS. 2, 4*a*, and 4*b*, the at least one hinge may comprises a first hinge body 65 and a second hinge body 67. As shown in FIGS. 1 and 2 the first hinge body 65 may be sized and configured to mount to the second end cap 11. As shown in FIG. 3, the second hinge body 65 may be sized and configured to attach to the pivoting plate 43. The first hinge body may be sized and configured to be removeably engaged with the second hinge body as shown in FIGS. 4*a* and 4*b*.

Additionally, either of the pairs of hinge bodies may be sized and configured such that a one hinge body returns to a first position relative to the other hinge body if the hinge bodies are displaced from a first position. This type of hinge allows the gate to be self-closing.

The gate panel 3 of the adjustable gate 1 may further include a first top cap 73, a first bottom cap 75, a second top cap 77, and a second bottom cap 79. The first top cap 73 is sized and configured to cover an engagement of the first end of the first reinforcing member 5 and the first pocket of the first end cap and accordingly the other top cap 77 and bottom caps 75, 79 cover the corner engagements of the gate panel 3.

The gate panel of the adjustable gate may also include a plurality of balusters 81 each having two ends. Each baluster may be sized and configured to attach to the first reinforcing member 5 at one end and to attach to the second reinforcing member 7 at the other end. The balusters may be attached using a fastener such as a screw. A cane bolt 82 and associated striker plate 83 and/or a latch 85 may also be included.

Figure 6:
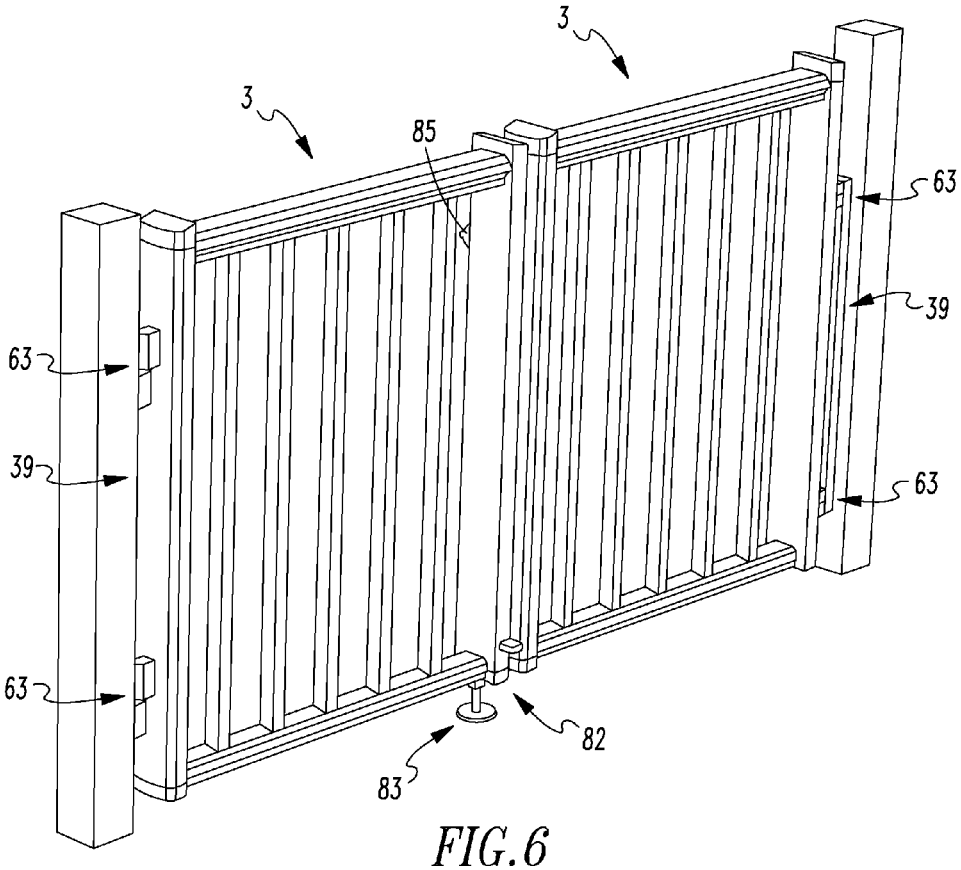
FIG. 6 is rear perspective view of another preferred embodiment of my adjustable gate.

In another embodiment the adjustable gate may be provided as a kit that includes a gate panel 3 and a pivotable mount assembly 39. The kit may also include more than one gate panel 3 and more than one pivotable mount assembly 39 such that a double gate 87 as shown in FIG. 6 can be constructed. In a kit with two gate panels, both a cane bolt and a latch may be included for properly holding the adjustable gate in a closed position.

While I have shown and described certain present preferred embodiments of my adjustable gate and have illustrated certain present preferred methods of making and using the same, it is to be distinctly understood that the invention is not limited thereto but may be otherwise variously embodied and practiced within the scope of the following claims.

I claim:

1. An adjustable gate comprising:

a gate panel;

a pivoting plate attached to the gate panel;

a mounting plate sized and configured to be mounted to a surface;

a first hinge body and a second hinge body, the first hinge body being attachable to the gate panel and the second hinge being attachable to the pivoting plate; and wherein the first hinge body is sized and configured to be removeably engaged with the second hinge body; and wherein the pivoting plate and the mounting plate each have a base and two parallel sides attached to the base, each of the parallel sides being substantially similar in shape to the other side; and wherein each side has an apex and a pivot pin hole near the apex; and a pivot pin passing through the pivot pin holes in the side of the pivoting plate and the sides of the mounting plate and connecting the pivoting plate to the mounting plate;

at least one setscrew, wherein the at least one setscrew passes through the base of the pivoting plate and attaches to the mounting plate; and wherein the at least one setscrew restricts movement of the pivoting plate about the pivot pin and; wherein the at least one setscrew is threadably engaged to the mounting plate.

2. The adjustable gate of claim 1 wherein the gate panel comprises:

a top railing having a first end and a second end;

a bottom railing having a first end and a second end;

a first end cap having a first end and a second end, the first end having a first pocket, and the second end having a second pocket;

a second end cap having a first end and a second end, the first end having a first pocket, and the second end having a second pocket; and wherein the first end of the top railing engages the first pocket of the first end cap and the second end of the top railing engages the first pocket of the second end cap; and wherein the first end of the bottom railing engages the second pocket of the first end cap and the second end of the bottom railing engages the second pocket of the second end cap.

3. The adjustable gate of claim 2 wherein the gate panel further comprises a plurality of balusters each having two ends, wherein each baluster attaches to the top railing at one end and attaches to the bottom railing at the other end.

4. The adjustable gate of claim 2 wherein the top railing comprises:

a top railing cover section and a first reinforcing member having a first end and a second end; and wherein the bottom railing comprises:

a bottom railing cover section and a second reinforcing member having a first end and a second end; and wherein the top railing cover section engages the first reinforcing member; and wherein the bottom railing cover section engages the second reinforcing member; and wherein the first end of the first reinforcing member engages the first pocket of the first end cap, the first end of the second reinforcing member engages the second pocket of the first end cap, the second end of the first reinforcing member engages the first pocket of the second end cap, and the second end of the second reinforcing member engages the second pocket of the second end cap.

5. The adjustable gate of claim 4 wherein the gate panel further comprises a first top cap, a first bottom cap, a second top cap, and a second bottom cap, and wherein the first top cap covers an engagement of the first end of the first reinforcing member and the first pocket of the first end cap, the first bottom cap covers an engagement of the first end of the second reinforcing member and the second pocket of the first end cap, the second top cap covers an engagement of the second end of the first reinforcing member and the first pocket of the second end cap, and the second bottom cap covers an engagement of the second end of the second reinforcing member and the second pocket of the second end cap.

6. The adjustable gate of claim 4 wherein the first end cap, the second end cap, the top railing cover section, and the bottom railing cover section are a plastic extrusion.

7. The adjustable gate of claim 4 wherein the first reinforcing member and the second reinforcing member have been formed by an extrusion process.

8. The adjustable gate of claim 1 wherein the pivoting plate and the mounting plate are made of metal.

9. The adjustable gate of claim 1 wherein the at least one setscrew is a first setscrew and a second setscrew.

10. The adjustable gate of claim 1 wherein the first hinge body is sized and configured to return to a first position relative to the second hinge body if the first hinge body is displaced from the first position.

11. The adjustable gate of claim 1 further comprising a cane bolt and an associated striker plate, wherein the cane bolt attaches to the first end cap.

12. An adjustable gate comprising:

a first reinforcing member having a first end and a second end;

a second reinforcing member having a first end and a second end;

a first end cap having a first end and a second end, the first end having a first pocket, and the second end having a second pocket;

a second end cap having a first end and a second end, the first end having a first pocket, and the second end having a second pocket;

a top railing cover section;

a bottom railing cover section; and a pivotable mount assembly having a pivot pin, a first section and a second section, the first section of the pivotable mount assembly comprising a mounting plate and the second section of the pivotable mount assembly comprising a pivoting plate, the pivoting plate and the mounting plate each having a base and two parallel sides attached to the base; and at least one hinge comprising a first hinge body and a second hinge body, wherein the first hinge body is attached to the second end cap and the second hinge body is attached to the second section of the pivotable mount assembly, and wherein the first hinge body is sized and configured to be removeably engaged with the second hinge body; and wherein the pivoting plate is sized and configured to be mounted to the second end cap and the pivot pin is sized and configured to hold the mounting plate and the pivoting plate in a pivoting engagement such that pivotable adjustment is accomplished based on rotational motion of the pivoting plate about the pivot pin relative to the mounting plate; and wherein the first end of the first reinforcing member engages the first pocket of the first end cap and the second end of the first reinforcing member engages the first pocket of the second end cap; and wherein the first end of the second reinforcing member engages the second pocket of the first end cap and the second of the second reinforcing member engages the second pocket of the second end cap; and wherein the top railing cover section engages the first reinforcing member; and wherein the bottom railing cover section engages the second reinforcing member; and wherein the first section of the pivotable mount assembly is sized and configured to be mounted to a surface and the second section of the pivotable mount assembly is attached to the second end cap such that the first section and the second section of the pivotable mount assembly are configured and connected together to permit pivotable adjustment of the adjustable gate in which at least one end of the second section is moved toward or away from a corresponding end of the first section; and wherein the pivotable mount assembly comprises at least one setscrew, wherein the at least one setscrew passes through the base of the pivoting plate and attaches to the mounting plate; and wherein the at least one setscrew restricts movement of the pivoting plate about the pivot pin and; wherein the at least one setscrew is threadably engaged to the mounting plate.

13. The adjustable gate of claim 12 further comprising a plurality of balusters each having two ends, wherein each baluster attaches to the first reinforcing member at one end and attaches to the second reinforcing member at the other end.

14. The adjustable gate of claim 12 wherein the mounting plate has an apex with an aperture defined at the apex and the pivoting plate has an apex with an aperture defined at the apex, and wherein the pivot pin is located within the aperture of the mounting plate and the aperture of the pivoting plate.

15. The adjustable gate of claim 12 wherein the first hinge body is sized and configured to return to a first position relative to the second hinge body if the first hinge body is displaced from the first position.

16. A kit for an adjustable gate comprising:

a gate panel, the gate panel comprising:

a first reinforcing member having a first end and a second end, a second reinforcing member having a first end and a second end, a first end cap having a first end and a second end, the first end having a first pocket, and the second end having a second pocket, a second end cap having a first end and a second end, the first end having a first pocket, and the second end having a second pocket, a top railing cover section, a bottom railing cover section, the first end of the first reinforcing member being sized and configured to engage the first pocket of the first end cap and the second end of the first reinforcing member being sized and configured to engage the first pocket of the second end cap, the first end of the second reinforcing member being sized and configured to engage the second pocket of the first end cap and the second of the second reinforcing member being sized and configured to engage the second pocket of the second end cap, the top railing cover section being sized and configured to engage the first reinforcing member, wherein the bottom railing cover section being sized and configured to engage the second reinforcing member; and a pivotable mount assembly comprising:

a pivoting plate sized and configured to attach to the gate panel, a mounting plate, and a pivot pin; and at least one setscrew, wherein the at least one setscrew passes through the base of the pivoting plate and attaches to the mounting plate; and wherein the at least one setscrew restricts movement of the pivoting plate about the pivot pin and; wherein the at least one setscrew is threadably engaged to the mounting plate; and wherein the pivoting plate and the mounting plate each have a base and two parallel sides attached to the base, each of the parallel sides being substantially similar in shape to the other side; and wherein each side has an apex and a pivot pin hole near the apex; and at least one hinge assembly comprising:

a first hinge body, and a second hinge body, wherein the first hinge body is attachable to the second end cap and the second hinge is attachable to the second section of the pivotable mount assembly, and wherein the first hinge body is sized and configured to be removeably engaged with the second hinge body.

17. The kit of claim 16 further comprising a first top cap, a second top cap, a first bottom cap, and a second bottom cap, the first top cap being sized and configured to engage the first end of the first end cap and to cover the first pocket of the first end cap, the second top cap being sized and configured to engage the first end of the second end cap and to cover the first pocket of the second end cap, the first bottom cap being sized and configured to engage the second end of the first end cap and to cover the second pocket of the first end cap, and the second bottom cap being sized and configured to engage the second end of the second end cap and to cover the second pocket of the second end cap.

* * * * *